US007958576B1

(12) United States Patent
Johnson et al.

(10) Patent No.: US 7,958,576 B1
(45) Date of Patent: Jun. 14, 2011

(54) DECORATIVE TOILET FOR THE PHYSICALLY CHALLENGED

(76) Inventors: William C. Johnson, Daytona Beach, FL (US); Phyllis Rehmar, Daytona Beach, FL (US)

( * ) Notice: Subject to any disclaimer, the term of this patent is extended or adjusted under 35 U.S.C. 154(b) by 0 days.

(21) Appl. No.: 12/798,485

(22) Filed: May 24, 2010

(51) Int. Cl.
*E03D 1/14* (2006.01)

(52) U.S. Cl. ..... 4/324; 4/326; 4/346; 4/237; 4/239

(58) Field of Classification Search ..... 4/324, 326, 4/345, 346, 237, 239, 240, 236
See application file for complete search history.

(56) References Cited

U.S. PATENT DOCUMENTS

| | | | | |
|---|---|---|---|---|
| 1,243,148 | A * | 10/1917 | Erwin | 4/254 |
| 3,719,958 | A * | 3/1973 | Wilhelm | 4/424 |
| 3,763,501 | A * | 10/1973 | Minardi, Jr. | 4/326 |
| 3,894,299 | A * | 7/1975 | Cleary | 4/326 |
| 4,819,277 | A * | 4/1989 | Sikirov | 4/254 |
| 5,708,989 | A * | 1/1998 | Ellis | 4/237 |
| 7,093,308 | B2 * | 8/2006 | Berlovan et al. | 4/237 |
| 2005/0177932 | A1 * | 8/2005 | Hilton | 4/237 |
| 2006/0156459 | A1 * | 7/2006 | Hsu | 4/237 |
| 2009/0307832 | A1 * | 12/2009 | Pereira Del Arroyo | 4/254 |

* cited by examiner

*Primary Examiner* — Khoa D Huynh

(57) ABSTRACT

A toilet is designed and constructed to accommodate the physically challenged persons. The toilet has a wider sitting area to accommodate person of various sizes. The toilet also includes a pair of handles for assisting a person in getting on and off the toilet. The flushing action is accomplished by pulling flush knobs located in the handles while the person is sitting on the toilet.

2 Claims, 8 Drawing Sheets

Figure 1A:
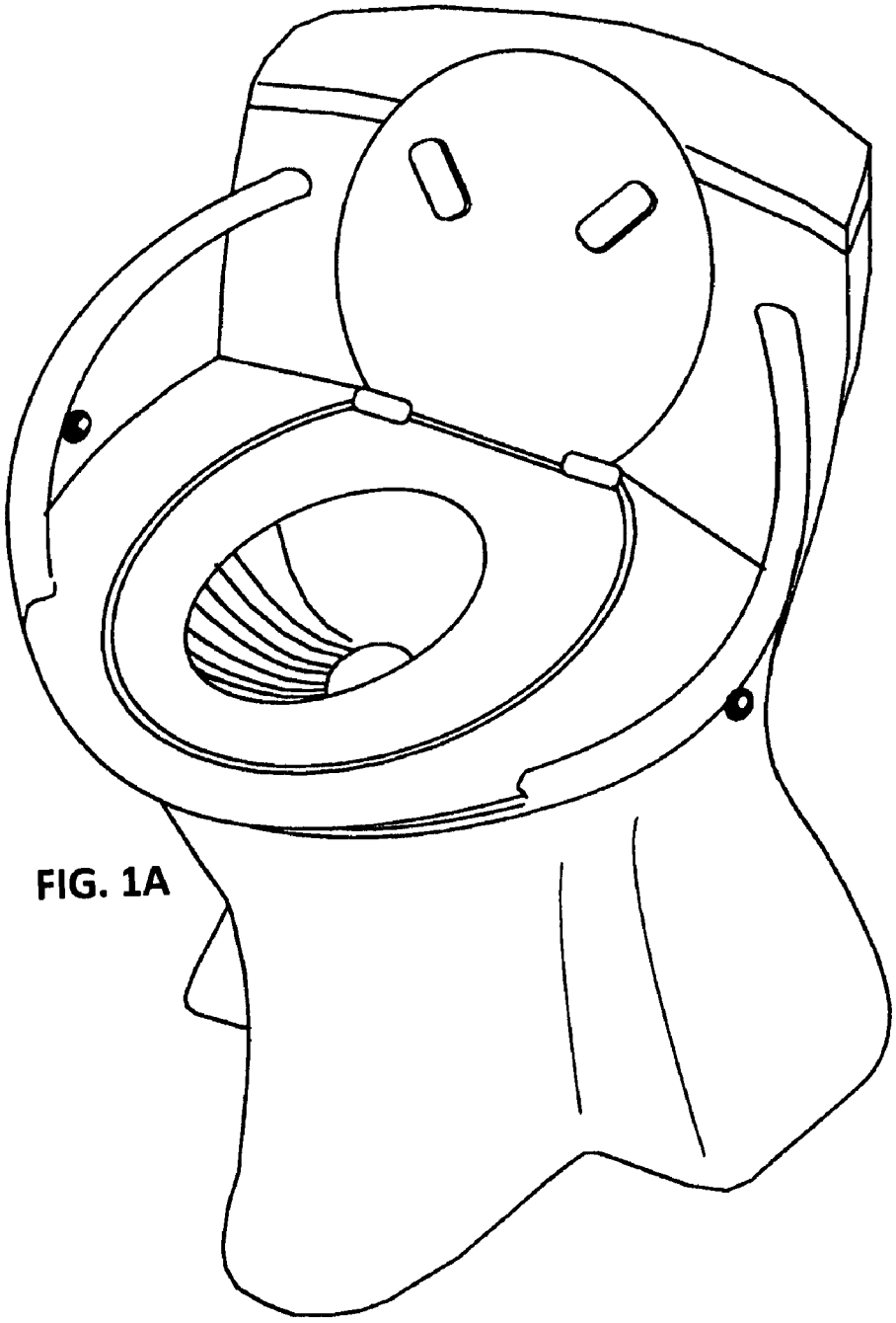
Figure 1B:
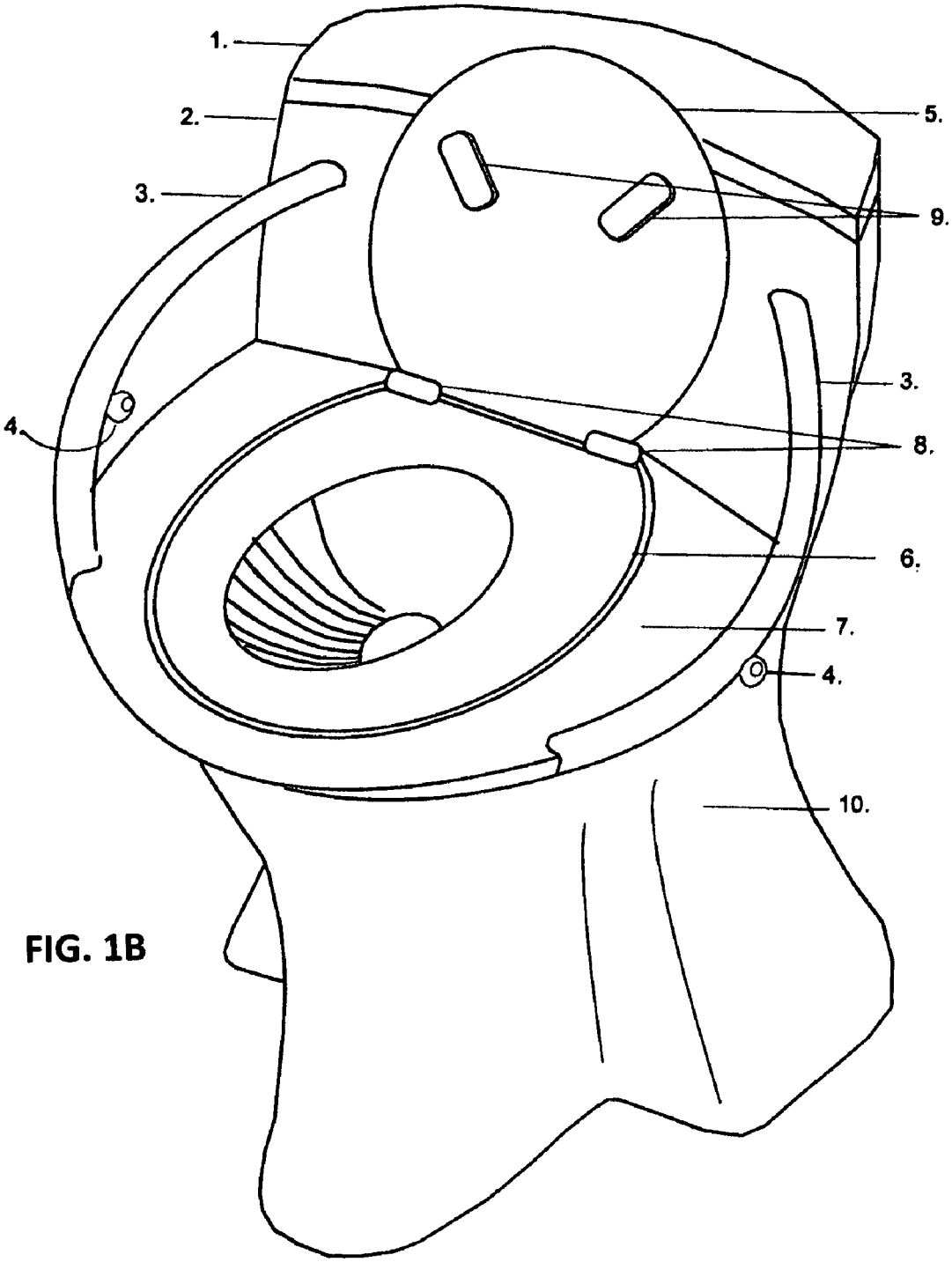
Figure 2A:
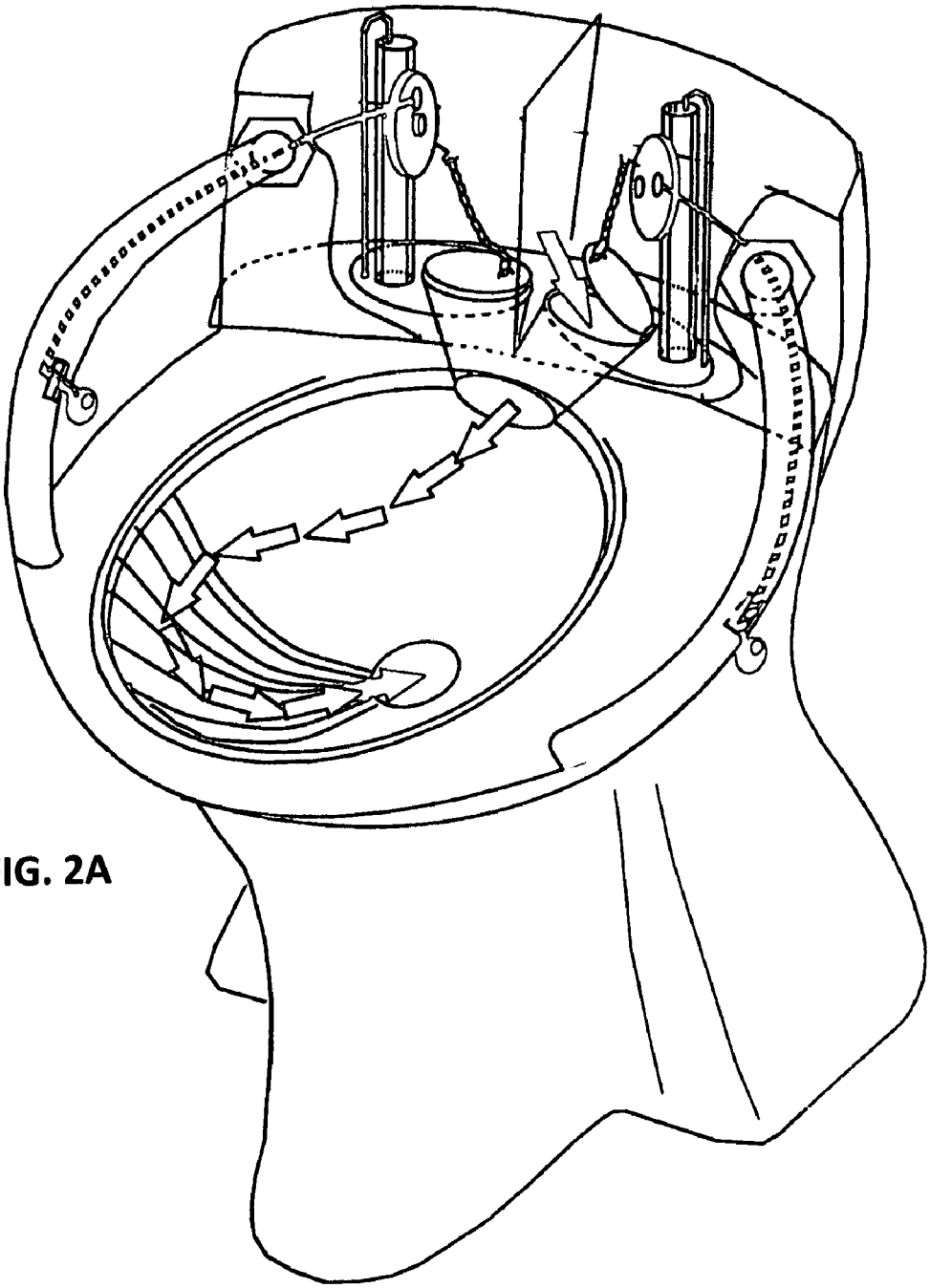
Figure 2B:
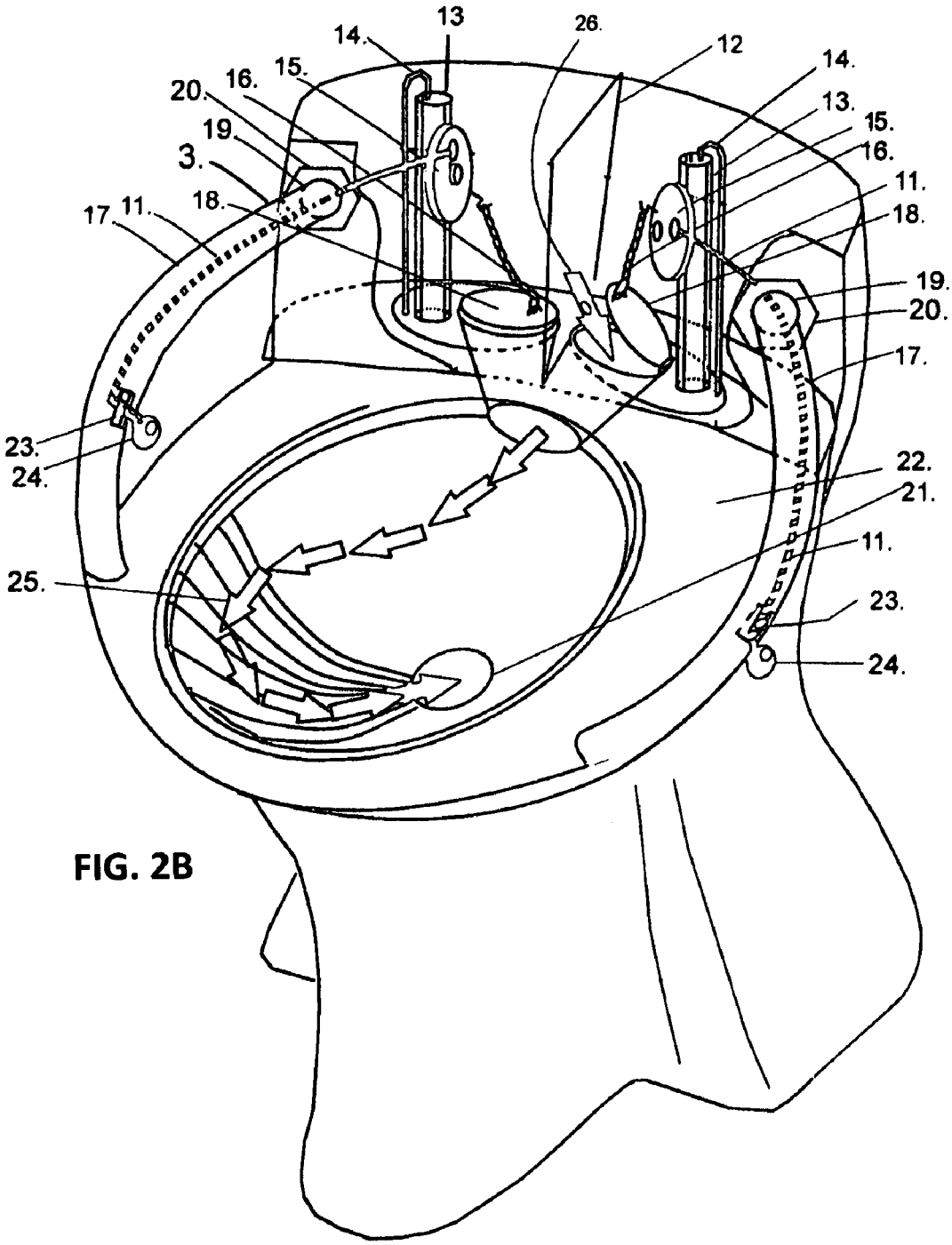
Figure 3A:
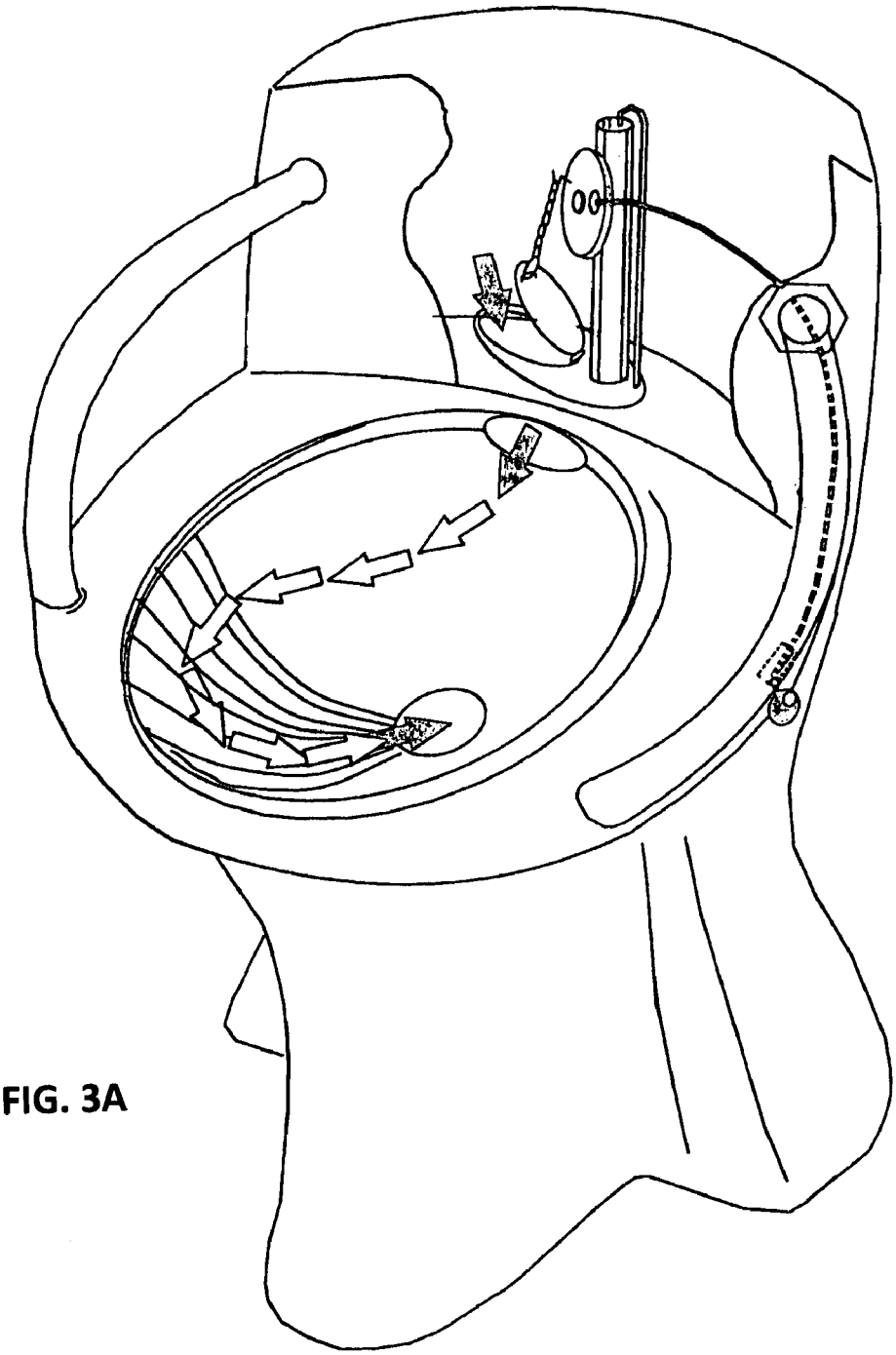
Figure 3B:
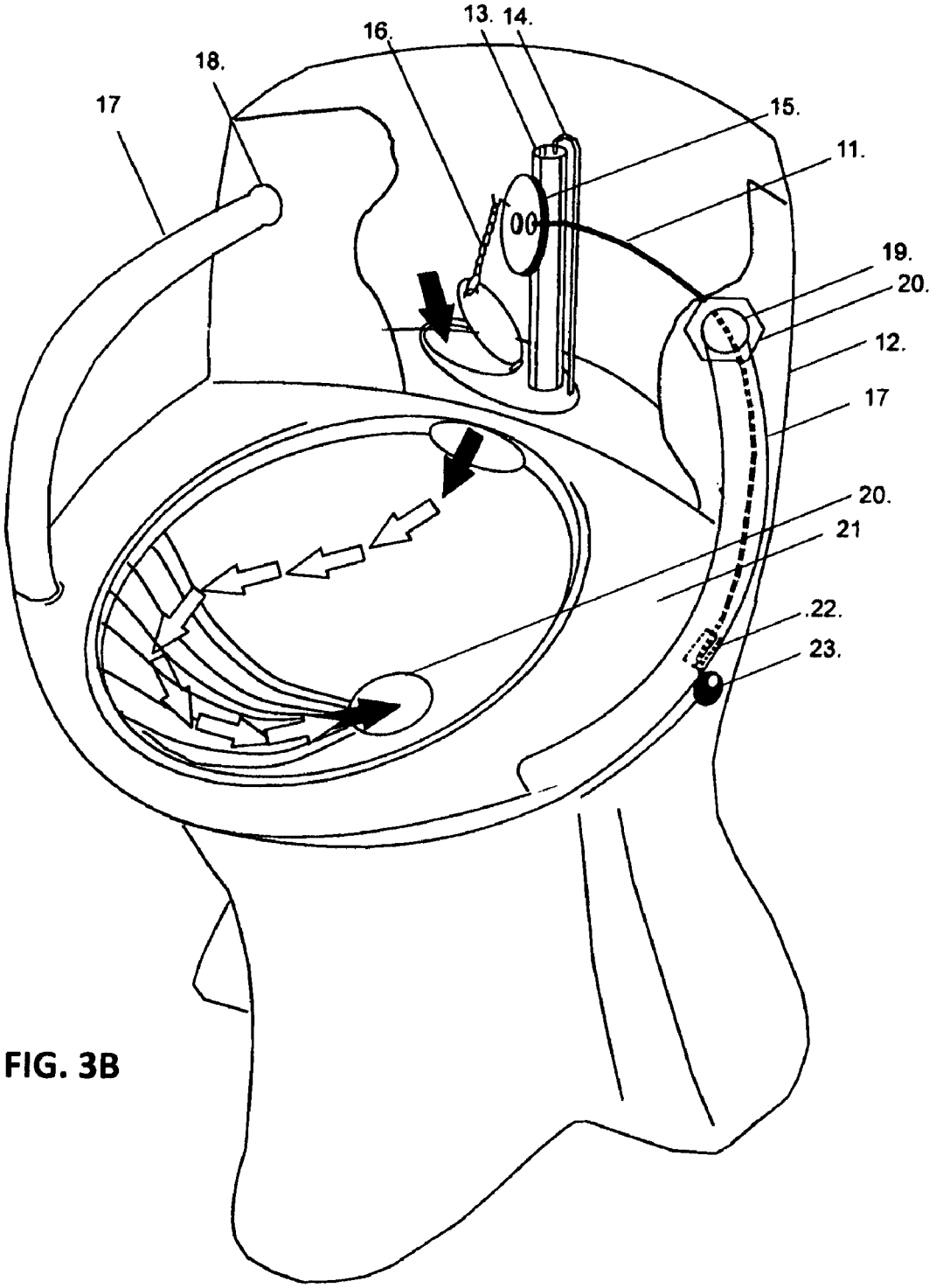

Single Flush nomenclature
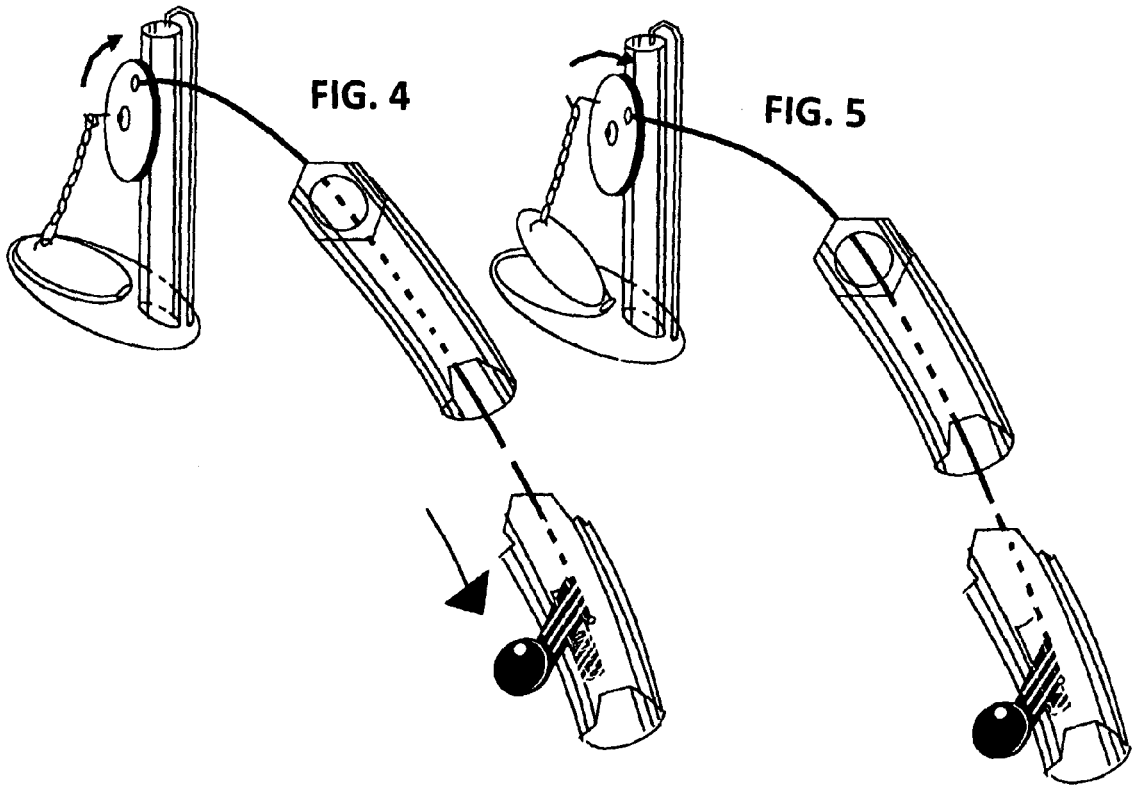

Push rod with spring retainer attachment to inside of handle
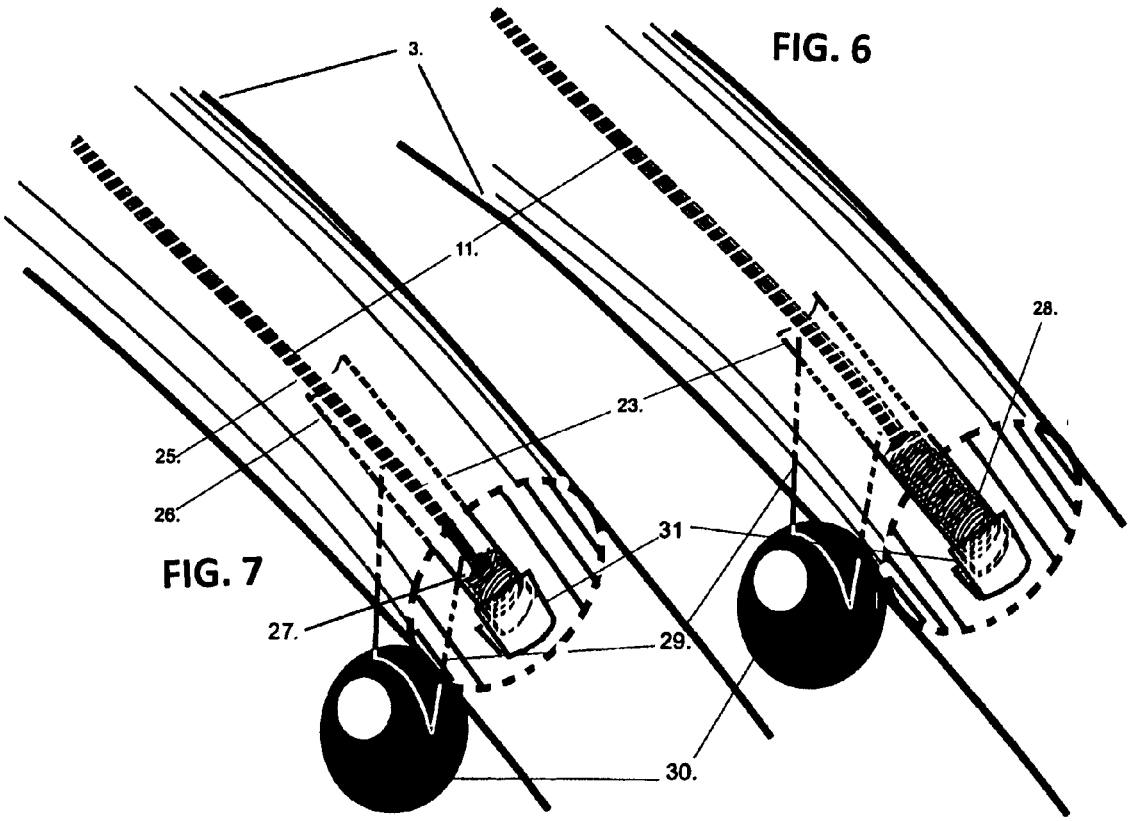

DECORATIVE TOILET FOR THE PHYSICALLY CHALLENGED

DESCRIPTION OF THE EMBODIMENT

FIGURE A: 1. Water closet lid; 2. Water closet or tank; 5. Toilet lid with concave top; 6. Recessed toilet seat having an central aperture; 7. Toilet top having a central opening with a seat recessed formed therein; 8. Toilet hinge to allow pivotal movement for both the toilet seat 6 and lid 5; 9. Toilet lid cushions mounted in the inner surface of the toilet lid 5; 10. Toilet base.

FIGURE B (Dual flush Toilet): 11. Left and right push rods; 12. Divider for dividing the water closet or tank 2 into a left side compartment and a right side compartment; 13. Overflow tube(s); 14. Water filler tube(s); 15. Rotating flapper wheel(s) attached to the overflow tubes 13; 16. Flapper chain (s); 17. Left and right side hollow continues handles having first ends connected directly to the left and right side openings 19; 18. Flapper lid(s); 19. A pair (left and right side) of openings formed therein for first ends of handles 17; 20. Handle retainer nut and gasket; 21. Toilet bowl exit adapted to connect to a sewer drain; 22. Wider sitting area to support various sizes persons; 23. Elongated slot(s) formed near the second end of the handles 17; 25. Flush water flow thru the water outlet hole, when the flapper lid(s) is/are opened, around bowl and out bowl exit 21.

FIGURE C (Single flush Toilet): 11. Push rod, single push rod located in either right or left hollow continues handles; 12. Water closet or tank (no divider); 13. Overflow tube; 14. Water filler tube; 15. Rotating flapper wheel attached to overflow tube 13; 16. Flapper chain; 17. Right and left hollow continues handles; 19—Openings in water closet for both ends of handles; 20. Handle retainer nut and gasket.

FIGURES D and E schematically show the flushing mechanism that comprises the flexible flushing rods and push rod.

FIGURES F and G (Push rod spring): 11. Push rods. 23. Elongated slot(s) formed near the second end of the handles for allowing the push rod arms 29 to extend therethrough; 27 and 28. Spring(s) located inside the hollow handle(s) at the forward ends for biasing the flushing rod(s); 27. Spring in the flushing configuration (compressed state); 28. Spring in the non-flushing configuration (non compressed state); 29. Push rod arm(s) having a proximal end connected to the forward end of the flushing rod and a distal end extended radially through the elongated slot of the handle; 30. Push rod knobs attached to the distal ends of the push rod arms 29; 31. Spring retainer anchors formed inside the left and right hollow handles for retaining the springs 27 and 28.

As illustrated in the Figures, a toilet comprises: a toilet base (10) adapted for mounting on a floor, the toilet base (10) having a toilet bowl formed therein, the toilet bowl having a toilet bowl exit (21) for allowing waste content and flush water to exit and a toilet top (7) having a central opening with a seat recess formed therein, the toilet bowl exit (21) is adapted to connect to a sewer drain, a recessed toilet seat (6) having a central aperture, the recessed toilet seat (6) is mounted to the toilet top (7) by a toilet hinge (8) to allow pivotal movement between a use position, where the toilet seat is lowered and recessed into the seat recess, and a non-use position where the toilet seat is raised vertically out of alignment with the seat recess, wherein in the use position the recessed toilet seat is flush with the toilet top of the toilet, and the toilet seat in combination with the toilet top defined a wider sitting area (22) on the top of the toilet to support various sizes persons, a toilet lid (5) mounted to the toilet top (7) by the toilet hinge (8), the toilet lid having a top which is concave to provide additional sitting when the toilet lid is pivoted to a close position where the toilet lid is positioned horizontally on top of the recessed toilet seat (6) such that the toilet lid (5) covers the central aperture of the recessed toilet seat (6), the toilet lid having a plurality of seat cushions (9) mounted on the inner surface thereof. A water closet or tank (2) mounted on the toilet top (7) behind the toilet seat (6) and the toilet lid (5), the water closet includes a lid (1), the water closet is adapted to connect to a water source for supplying water to the water closet or tank for flushing the waste content in the toilet bowl; the water closet further comprises: an overflow tube (13), a water filled tube (14), a rotating flapper wheel (15) located inside the water closet and attached to the overflow tube (13), a flapper lid (18) for selectively closing and opening a water outlet hole formed at the bottom of the water closet for allowing flush water to flow into the toilet bowl, a flapper chain (16) having one end connected to the flapper lid (18) and an opposite end connected to the rotating flapper wheel (15). A pair of openings (19) formed on a front side wall of the water closet, and a pair of hollow continuous handles (17), each of the handles having a first end connected directly to the each of the openings via a handle nut and gasket (20) and a second end connected directly to the toilet top (7), a elongated slot (23) formed near the second end of each of the handles, wherein the handles are utilized to aid the persons for getting on and off the toilet, and a flexible flushing rod (11) installed inside one of the hollow continuous handles, the flushing rod having a back end connected to the rotating flapper wheel (15) and a forward end, the forward end having a push rod arm (29) attached thereto, the push rod arm (29) comprises a proximal end connected to the forward end of the flushing rod and a distal end extended radially through the elongated slot of the handle, a push rod knob (30) attached to the distal end of the push rod arm (29), and a spring located in and retained by a spring retainer anchor formed inside the hollow handle at the forward end for biasing the flushing rod, the push knob is used to slide the flushing rod from a non-flushing configuration to a flushing configuration while the person is sitting on the toilet, wherein when the push knob is pulled, the flushing rod is pushed forward to the flushing configuration and compressed the spring, the forward movement of the flushing rod rotates the rotating flapper wheel (15) which in turn raises the flapper chain (15) and opens the flapper lid (18), as the flapped lid is opened the water is allowed to flow through the water outlet hole and into the toilet bowl to create the flushing action of the toilet, wherein when the push knob is released, the spring returns to its non-compressed state and pushes the flushing rod to the non-flushing configuration in which the flapper lid (18) is allowed to close by gravity and supply water is allowed to refill the water closet or tank.

In a further embodiment, a toilet comprises: a toilet base (10) adapted for mounting on a floor, the toilet base (10) having a toilet bowl formed therein, the toilet bowl having a toilet bowl exit (21) for allowing waste content and flush water to exit and a toilet top (7) having a central opening with a seat recess formed therein, the toilet bowl exit (21) is adapted to connect to a sewer drain, a recessed toilet seat (6) having a central aperture, the recessed toilet seat (6) is mounted to the toilet top (7) by a toilet seat hinge (8) to allow pivotal movement between a use position, where the toilet seat is lowered and recessed into the seat recess, and a non-use position where the toilet seat is raised vertically out of alignment with the seat recess, wherein in the use position the recessed toilet seat is flush with the toilet top of the toilet, and the toilet seat in combination with the toilet top defined a wider sitting area (22) on the top of the toilet to support various sizes persons. A toilet lid (5) mounted to the toilet top (7) by the toilet seat hinge (8), the toilet lid having a top which is concave to provide additional sitting when the toilet lid is pivoted to a close position where the toilet lid is positioned horizontally on top of the recessed toilet seat (6) such that the toilet lid (5) covers the central aperture of the recessed toilet seat (6), the toilet lid having a plurality of seat cushions (9) mounted on the inner surface thereof. A water closet or tank (2) mounted on the toilet top (7) behind the toilet seat (6) and the toilet lid (5), the water closet includes a lid (1) and a divider (12) that divides the water closet or tank into a left side compartment and a right side compartment, the water closet is adapted to connect to a water source for supplying water to the water closet or tank for flushing the waste content in the toilet bowl; each of the left and right side compartments of the water closet further comprises: an overflow tube (13), a water filled tube (14), a rotating flapper wheel (15) attached to the overflow tube (13), a flapper lid (18) for selectively closing and opening a water outlet hole formed at the bottom of the water closet for allowing flush water to flow into the toilet bowl, a flapper chain (16) having one end connected to the flapper lid (18) and an opposite end connected to the rotating flapper wheel (15). A left opening and a right side opening (19) formed on a respective front side wall of each of the left and right side compartment of the water closet, and a left side hollow continuous handle and a right side hollow continuous handle (17), each of the left and right side handles having a first end connected directly to the each of the left and right side openings via a handle nut and gasket (20) and a second end connected directly to the respectively left and right side of the toilet top (7), each of the second end of each of the handles having a elongated slot (23) formed adjacent thereof, wherein the handles are utilized to aid the persons for getting on and off the toilet, and a left flexible flushing rod and a right flexible flushing rod (11), the left and right flushing rods are installed inside the respective left and right hollow continuous handles (17), each of the flushing rods having a back end connected to one of the rotating flapper wheels (15) and a forward end, the forward end having a push rod arm (29) attached thereto, the push rod arm (29) having a proximal end connected to the forward end of the flushing rod and a distal end extended radially through the elongated slot of the handle, a push rod knob (30) attached to the distal end of the push rod arm (29), and a left spring and a right spring located in and retained by spring retainer anchors formed inside the left and right hollow handles (17) at the forward ends for biasing the left and right flushing rods (11), wherein the left and right push knobs (30) are used to independently slide the each of the flushing rods or to simultaneously slide both flushing rods from non-flushing configuration to a flushing configuration while the person is sitting on the toilet, wherein when the push knobs are pulled, the flushing rods are pushed forward to the flushing configuration and compressed the springs, the forward movement of the flushing rods rotates the rotating flapper wheels (15) which in turn raise the flapper chains (15) and open the flapper lids (18), as the flapped lids are opened the water in the compartments is allowed to flow through the water outlet holes and into the toilet bowl to create the flushing action of the toilet, wherein when the push knobs are released, the springs return to their non-compressed state and push the flushing rods to the non-flushing configuration in which the flapper lids (18) are allowed to close by gravity and supply water is allowed to refill the water closet or tank, and wherein when both of the left and right flush knobs are pulled simultaneously, the water from both compartments is dispensed into the toilet bowl for flushing and when either of the left and right flush knobs is pulled individually one half of the stored water supply is dispensed.

The invention claimed is:

1. A toilet comprises:

a toilet base (10) adapted for mounting on a floor, the toilet base (10) having a toilet bowl formed therein, the toilet bowl having a toilet bowl exit (21) for allowing waste content and flush water to exit and a toilet top (7) having a central opening with a seat recess formed therein, the toilet bowl exit (21) is adapted to connect to a sewer drain, a recessed toilet seat (6) having a central aperture, the recessed toilet seat (6) is mounted to the toilet top (7) by a toilet hinge (8) to allow pivotal movement between a use position, where the toilet seat is lowered and recessed into the seat recess, and a non-use position where the toilet seat is raised vertically out of alignment with the seat recess, wherein in the use position the recessed toilet seat is flush with the toilet top of the toilet, and the toilet seat in combination with the toilet top defined a wider sitting area (22) on the top of the toilet to support various sizes persons, a toilet lid (5) mounted to the toilet top (7) by the toilet hinge (8), the toilet lid having a top which is concave to provide additional sitting when the toilet lid is pivoted to a close position where the toilet lid is positioned horizontally on top of the recessed toilet seat (6) such that the toilet lid (5) covers the central aperture of the recessed toilet seat (6), the toilet lid having a plurality of seat cushions (9) mounted on the inner surface thereof, a water closet or tank (2) mounted on the toilet top (7) behind the toilet seat (6) and the toilet lid (5), the water closet includes a lid (1), the water closet is adapted to connect to a water source for supplying water to the water closet or tank for flushing the waste content in the toilet bowl; the water closet further comprises: an overflow tube (13), a water filled tube (14), a rotating flapper wheel (15) located inside the water closet and attached to the overflow tube (13), a flapper lid (18) for selectively closing and opening a water outlet hole formed at the bottom of the water closet for allowing flush water to flow into the toilet bowl, a flapper chain (16) having one end connected to the flapper lid (18) and an opposite end connected to the rotating flapper wheel (15), a pair of openings (19) formed on a front side wall of the water closet, and a pair of hollow continuous handles (17), each of the handles having a first end connected directly to the each of the openings via a handle nut and gasket (20) and a second end connected directly to the toilet top (7), a elongated slot (23) formed near the second end of each of the handles, wherein the handles are utilized to aid the persons for getting on and off the toilet, and a flexible flushing rod (11) installed inside one of the hollow continuous handles, the flushing rod having a back end connected to the rotating flapper wheel (15) and a forward end, the forward end having a push rod arm (29) attached thereto, the push rod arm (29) comprises a proximal end connected to the forward end of the flushing rod and a distal end extended radially through the elongated slot of the handle, a push rod knob (30) attached to the distal end of the push rod arm (29), and a spring located in and retained by a spring retainer anchor formed inside the hollow handle at the forward end for biasing the flushing rod, the push knob is used to slide the flushing rod from a non-flushing configuration to a flushing configuration while the person is sitting on the toilet, wherein when the push knob is pulled, the flushing rod is pushed forward to the flushing configuration and compressed the spring, the forward movement of the flushing rod rotates the rotating flapper wheel (15) which in turn raises the flapper chain (15) and opens the flapper lid (18), as the flapped lid is opened the water is allowed to flow through the water outlet hole and into the toilet bowl to create the flushing action of the toilet, wherein when the push knob is released, the spring returns to its non-compressed state and pushes the flushing rod to the non-flushing configuration in which the flapper lid (18) is allowed to close by gravity and supply water is allowed to refill the water closet or tank.

2. A toilet comprises:

a toilet base (10) adapted for mounting on a floor, the toilet base (10) having a toilet bowl formed therein, the toilet bowl having a toilet bowl exit (21) for allowing waste content and flush water to exit and a toilet top (7) having a central opening with a seat recess formed therein, the toilet bowl exit (21) is adapted to connect to a sewer drain, a recessed toilet seat (6) having a central aperture, the recessed toilet seat (6) is mounted to the toilet top (7) by a toilet seat hinge (8) to allow pivotal movement between a use position, where the toilet seat is lowered and recessed into the seat recess, and a non-use position where the toilet seat is raised vertically out of alignment with the seat recess, wherein in the use position the recessed toilet seat is flush with the toilet top of the toilet, and the toilet seat in combination with the toilet top defined a wider sitting area (22) on the top of the toilet to support various sizes persons, a toilet lid (5) mounted to the toilet top (7) by the toilet seat hinge (8), the toilet lid having a top which is concave to provide additional sitting when the toilet lid is pivoted to a close position where the toilet lid is positioned horizontally on top of the recessed toilet seat (6) such that the toilet lid (5) covers the central aperture of the recessed toilet seat (6), the toilet lid having a plurality of seat cushions (9) mounted on the inner surface thereof, a water closet or tank (2) mounted on the toilet top (7) behind the toilet seat (6) and the toilet lid (5), the water closet includes a lid (1) and a divider (12) that divides the water closet or tank into a left side compartment and a right side compartment, the water closet is adapted to connect to a water source for supplying water to the water closet or tank for flushing the waste content in the toilet bowl; each of the left and right side compartments of the water closet further comprises: an overflow tube (13), a water filled tube (14), a rotating flapper wheel (15) attached to the overflow tube (13), a flapper lid (18) for selectively closing and opening a water outlet hole formed at the bottom of the water closet for allowing flush water to flow into the toilet bowl, a flapper chain (16) having one end connected to the flapper lid (18) and an opposite end connected to the rotating flapper wheel (15), a left opening and a right side opening (19) formed on a respective front side wall of each of the left and right side compartment of the water closet, and a left side hollow continuous handle and a right side hollow continuous handle (17), each of the left and right side handles having a first end connected directly to the each of the left and right side openings via a handle nut and gasket (20) and a second end connected directly to the respectively left and right side of the toilet top (7), each of the second end of each of the handles having a elongated slot (23) formed adjacent thereof, wherein the handles are utilized to aid the persons for getting on and off the toilet, and a left flexible flushing rod and a right flexible flushing rod (11), the left and right flushing rods are installed inside the respective left and right hollow continuous handles (17), each of the flushing rods having a back end connected to one of the rotating flapper wheels (15) and a forward end, the forward end having a push rod arm (29) attached thereto, the push rod arm (29) having a proximal end connected to the forward end of the flushing rod and a distal end extended radially through the elongated slot of the handle, a push rod knob (30) attached to the distal end of the push rod arm (29), and a left spring and a right spring located in and retained by spring retainer anchors formed inside the left and right hollow handles (17) at the forward ends for biasing the left and right flushing rods (11), wherein the left and right push knobs (30) are used to independently slide the each of the flushing rods or to simultaneously slide both flushing rods from non-flushing configuration to a flushing configuration while the person is sitting on the toilet, wherein when the push knobs are pulled, the flushing rods are pushed forward to the flushing configuration and compressed the springs, the forward movement of the flushing rods rotates the rotating flapper wheels (15) which in turn raise the flapper chains (15) and open the flapper lids (18), as the flapped lids are opened the water in the compartments is allowed to flow through the water outlet holes and into the toilet bowl to create the flushing action of the toilet, wherein when the push knobs are released, the springs return to their non-compressed state and push the flushing rods to the non-flushing configuration in which the flapper lids (18) are allowed to close by gravity and supply water is allowed to refill the water closet or tank, wherein when both of the left and right flush knobs are pulled simultaneously, the water from both compartments is dispensed into the toilet bowl for flushing and when either of the left and right flush knobs is pulled individually one half of the stored water supply is dispensed.

* * * * *